US006481030B2

(12) United States Patent
Bravo et al.

(10) Patent No.: US 6,481,030 B2
(45) Date of Patent: Nov. 19, 2002

(54) ADJUSTABLE BODY GUARD

(76) Inventors: Loretta L. Bravo, 4457 Yosemite Way, Los Angeles, CA (US) 90065; Shirley R. Manning, 4457 Yosemite Way, Los Angeles, CA (US) 90065

( * ) Notice: Subject to any disclaimer, the term of this patent is extended or adjusted under 35 U.S.C. 154(b) by 0 days.

(21) Appl. No.: 09/963,165

(22) Filed: Sep. 24, 2001

(65) Prior Publication Data

US 2002/0056159 A1 May 16, 2002

Related U.S. Application Data

(60) Provisional application No. 60/234,767, filed on Sep. 25, 2000.

(51) Int. Cl.[7] ..... A47C 21/08
(52) U.S. Cl. ..... 5/425; 5/427; 5/632; 5/663
(58) Field of Search ..... 5/630, 632, 424, 5/425, 427, 663, 946

(56) References Cited

U.S. PATENT DOCUMENTS 3,148,387 A * 9/1964 Sarnie, Jr. et al. ..... 5/424
4,872,228 A * 10/1989 Bishop ..... 5/425
4,873,734 A * 10/1989 Pollard ..... 5/425
5,035,014 A * 7/1991 Blanchard ..... 5/424
5,359,739 A * 11/1994 Rains et al. ..... 5/424
5,987,666 A * 11/1999 Zigmont ..... 5/424
6,347,422 B2 * 2/2002 Heavrin ..... 5/425

* cited by examiner

*Primary Examiner*—Michael F. Trettel
(74) *Attorney, Agent, or Firm*—Albert O. Cota

(57) ABSTRACT

An adjustable body guard (ABG) (10) that is designed to be attached, by an attachment means (46), to the side rails (70) as found on most hospital beds (72). The ABG (10) consists of an elongated resilient section (12) having a quarter-circle cross-section and that has two or three articulated sections (24, 26, 28) which allow the ABG (10) to be positioned to conform to the position in which a bed-confined patient is lying on the bed (72) or to the articulations of an adjustable hospital bed (72). Thus, the ABG (10) adds comfort and provides a degree of safety to the patient. For hygiene and to prevent the ABG (10) from being soiled, a washable full or partial cover (60, 62) is preferably placed over the ABG (10).

19 Claims, 3 Drawing Sheets

ADJUSTABLE BODY GUARD

This application claims the benefit of application No. 60/234,767, filed Sep. 25, 2000.

TECHNICAL FIELD

The invention pertains to the general field of pillows, bolsters and other body props, and more particularly to an adjustable body guard that is placed between a person lying in a hospital-type bed and the bed'side rails.

BACKGROUND ART

Specially-designed beds for use by injured or non-ambulatory persons have been in use for a long time. The most common example of this type of bed is the hospital bed. Typically, a hospital bed is single-sized with electrically-powered means for raising and lowering both the lower or upper leg section, and/or the torso section. Additionally, there are usually side rails on each side of the bed. These rails are used to prevent a patient from accidentally rolling off the bed, and therefore are constructed from a strong, rigid material such as metal.

A hospital bed with the rails raised may prevent a patient from rolling out of bed, but it may also cause sheet entanglement painful contact with the metal rails, patient's limbs being caught in the rails, or underweight patients slipping through the rails. Some patients prefer to remove or lower the rails to increase comfort, thus nullifying their safety and effectiveness.

There have been attempts to remedy this situation by the use of pillows or other similar items, which are placed parallel to the patient on either or both sides. Unfortunately, the majority of these remedies have not completely alleviated the problem. Obviously, if there were some why to provide a bed-confined individual with the necessary safety requirements, while at the same time providing a comfortable and positionable adjustable body guard, it would be a benefit to both patients and those who care for them.

A search of the prior art did not disclose any patents that read directly on the claims of the instant invention, however the following U.S. patents are considered related:

| PATENT NO. | INVENTOR | ISSUED |
|---|---|---|
| 6,067,679 | Rice | 30 May 2000 |
| 5,815,863 | Dolisi | 23 Sep. 1997 |
| 3,938,205 | Spann | 17 Feb. 1976 |

The U.S. Pat. No. 6,067,679 discloses a prop to hold a patient on his/her side while in a hospital bed in which a standard-sized hospital pillow is stowed in a rolled condition within a launderable sleeve. The sleeve has a flap that is tucked beneath the patient's side which allows limited patient rolling movement against the prop which contributes to patient comfort. The flap also keeps the prop close to the patient so that drastic movements which could cause injury do not occur.

The U.S. Pat. No. 5,815,863 discloses a lateral slumber support wedge for supporting a user, such as a pregnant woman, in a lateral slumber support, while lying down on either the left side or the right side. The wedge provides compressible, but firm support for the spine and pelvic region of the user. The wedge has a triangular cross section, and an interior body made of foam, which can provide support, but which conforms to the spinal and pelvic regions of the user. The wedge also includes a fabric cover which is permanently sewn to a bed sheet dividing the sheet in half so it can be used by the user lying on either the left or right side.

The U.S. Pat, No. 3,938,205 discloses a body positioner that is formed from a block of polyurethane foam having resilient characteristics capable of deformation and of permitting the passage of air. The positioner has an unsymmetrical pentagonal cross-section and a length substantially greater than its width so that the positioner can be rotated to provide for a variety of adjustable continuous positioning support surfaces.

For background purposes and as indicative of the art to which the invention is related reference may be made to the remaining cited patents.

| PATENT NO. | INVENTOR | ISSUED |
|---|---|---|
| 5,179,744 | Foster, et al | 1 Jan. 1993 |
| 4,502,169 | Persson | 5 Mar. 1985 |
| 4,215,446 | Mahoney | 5 Aug. 1980 |
| 3,430,272 | Thorn | 4 Mar. 1969 |
| 3,148,387 | Sarni, et al | 1 Sep. 1964 |

DISCLOSURE OF THE INVENTION

The adjustable body guard, (hereinafter ABG), is designed to be attached to the side of a bed, and more particularly to a set of side rails, which are found on many hospital beds. The ABG includes a prop that is designed to be attached to left side rails and a prop that is designed to be attached to right side rails. Each ABG is comprised of an elongated, resilient section that can be made with two articulated sections or preferably with three articulated sections. When the three section ABG is attached to the side rails, the three sections can be positioned to conform to a person lying on the bed.

The articulated ABG functions to prevent a patient from rolling off the side of the bed, to reduce sheet entanglement and to prevent pain that occurs when a patient repeatably makes contact with the hard metal side rails. The ABG prevents a patient's limb(s) from being caught in the rails, and underweight persons from slipping or partially slipping through the rails.

The ABG has a quarter circle cross-section with the radiused portion facing the patient. Although the quarter circle is preferred, the ABG can, for special cases, be made with circular or elliptical cross-sections. Additionally, to protect the ABG from being soiled, a full or partial cover can be attached over the ABG. The cover is preferably made of a washable material such as cotton or flannel, to assure hygiene.

In view of the above disclosure, the primary object of the invention is to produce an ABG that is easy to use, to maintain and that can be articulated to conform to the body of a bed-confined patient and to the articulation of an adjustable hospital bed.

In addition to the primary object of the invention, it is also an object of the invention to produce an ABG that:

- prevents a patient from placing their arms and/or legs between the mattress and the bed rail,
- can prevent moving arms and legs from striking the metal bed rails,
- can be used as a pillow, adds comfort and security to a patient lying in bed, can be dimensioned to accommodate most patients, is durable, maintains the bed sheets and blankets in a tucked position, can be made in different materials and colors, and is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
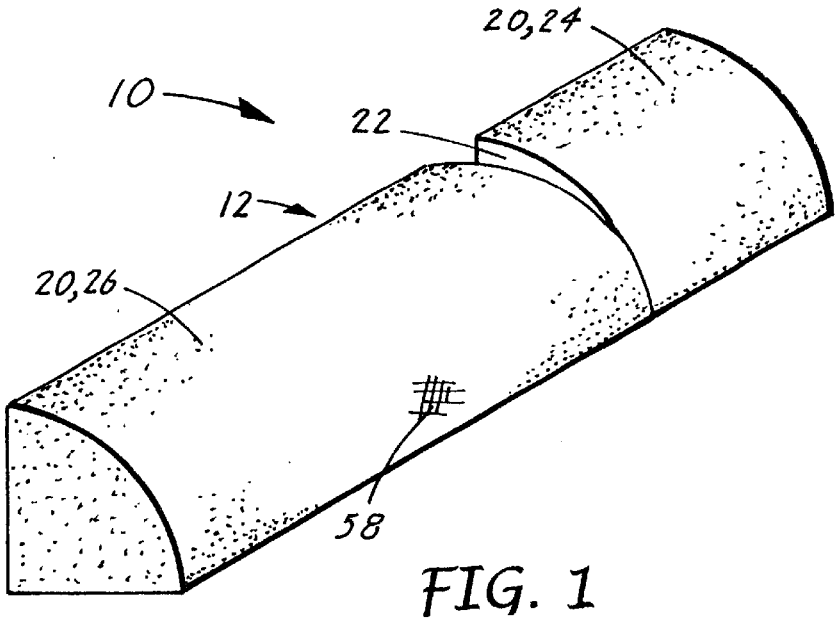
FIG. 1 is a perspective view of an ABG having an elongated, resilient section with a one-quarter circle cross-section and having two articulated sections.

The best mode for carrying out the invention is presented in terms of a preferred embodiment for an adjustable body guard (hereinafter "ABG 10"), The ABG 10, as shown in FIGS. 1–9, is adapted to be attached to a bed and more particularly to a side rail 70 as used on hospital bed 72. The ABG 10 allows a person lying on the bed to be comfortably protected from accidently rolling off the bed, getting caught between the rails and the mattress or being injured by the side rails 70. The ABG 10 is comprised of the following major elements: an elongated, resilient section 12, a positioning means 20, a first articulated section 24, a second articulated section 26, a third articulated section 28, a section/bed attachment means 40, and a full or partial protective cover 56 or 58.

The ABG 10 is made in two configurations. One ABG 10 is configured to be attached to a left side rail 70 and the other to be attached to a right side rail 70. The two configurations are mirror image of each other. Therefore, for purpose of the disclosure the ABG described is deemed to encompass both a right and left ABG 10.

Figure 2:
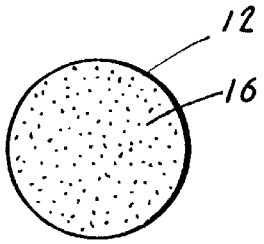
FIG. 2 is a front elevational view of an elongated resilient section having a circular cross-section.
Figure 3:
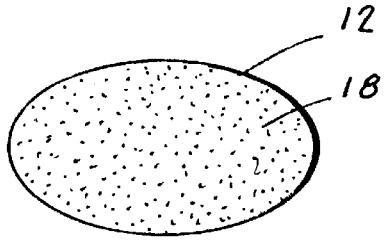
FIG. 3 is a front elevational view of an elongated resilient section having an elliptical cross-section.
Figure 6:
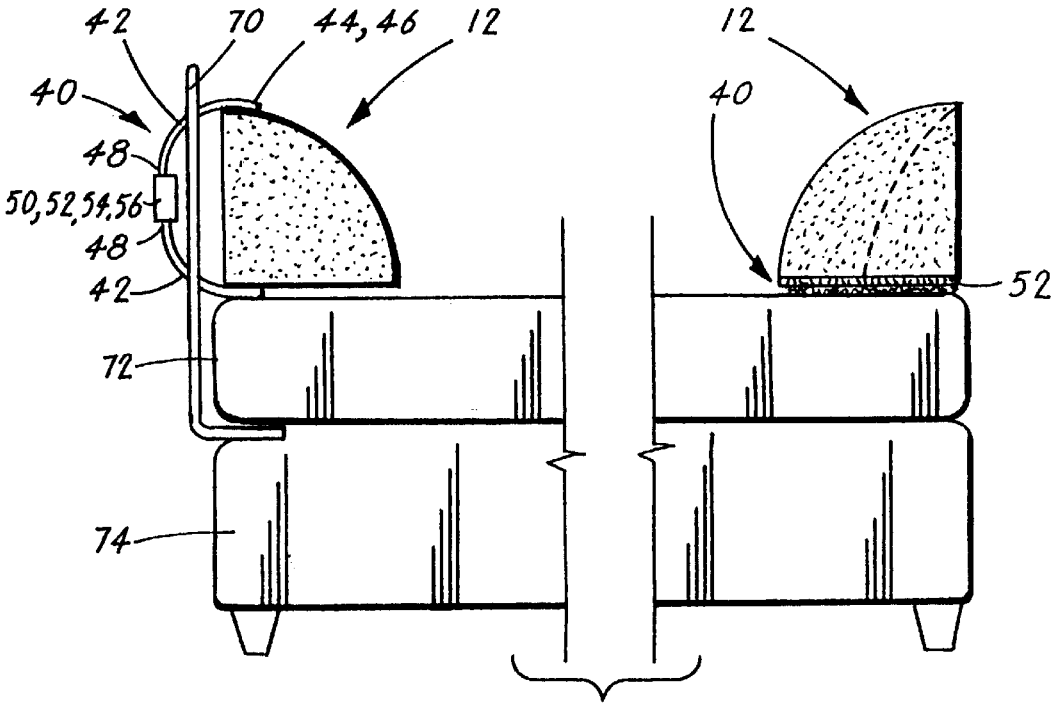
FIG. 6 is a front elevational view of an ABG shown on the left side of the figure that is attached to a vertical support by utilizing straps, and on the right side attached to a bed by means of a complimentary pair of hook and loop fasteners.

The elongated resilient section 12 is constructed from a material such as polyurethane, which passes CMHR flammability regulations for the hospitality industry which includes hospitals and hotels. The elongated resilient section 12 is preferably designed to have a quarter-circle cross section 14, as shown in FIGS. 1 and 6. However, a circular cross section 16, as shown in FIG. 2, or an elliptical cross section 18, as shown in FIG. 3, can also be utilized. Typically, the overall length of the ABG 10 is 48 inches (121.9 cm), and the width and height are each 7 inches (17.8 cm). With the preferred design having three articulated sections, the first section 20, that is the section adjacent the person's head is 18 inches (45.7 cm), the second section 26 is also 18 inches (45.7 cm), and the third section 28 is 12 inches (30.5 cm). Additionally, as shown in FIG. 6, the width of the resilient section 12 can be the full width of 7 inches (17.8 cm), as shown by the solid line, or can be less, such as 3.5 inches (8.8 cm). The shorter width can be used to accommodate a person who may be overweight.

Figure 4:
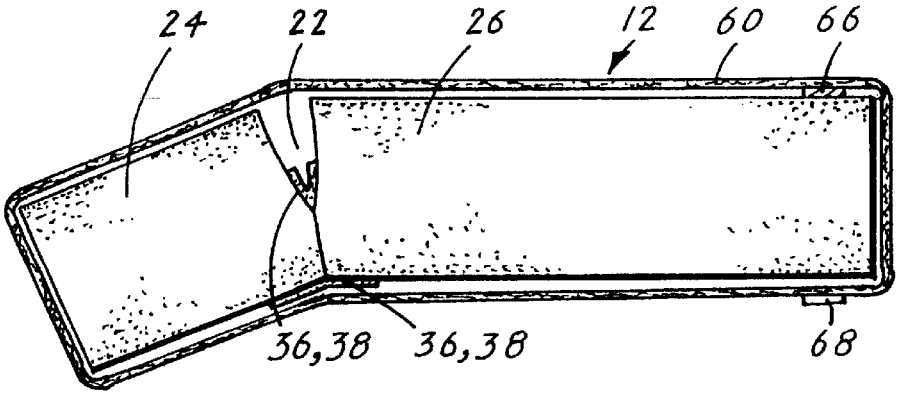
FIG. 4 is a side elevational view of an ABG two articulated sections divided by a partial lateral cut that is supported by means of reinforced tape and wherein the support is enclosed within a protective cover.
Figure 5:
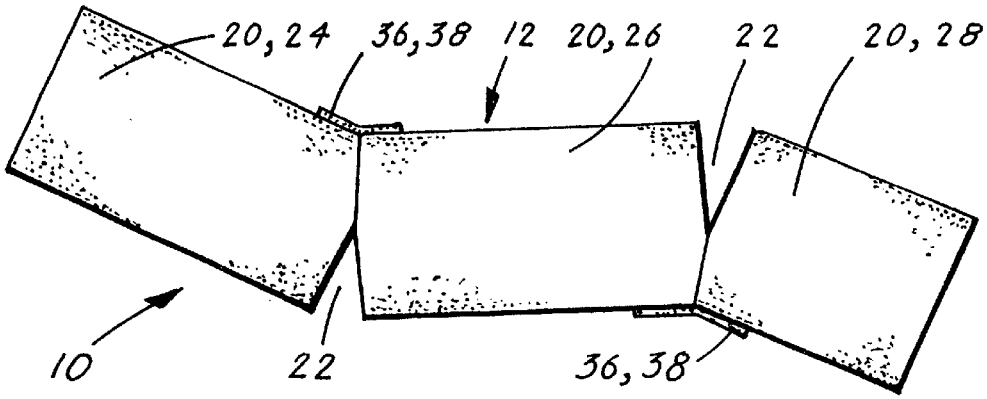
FIG. 5 is a side elevational view of a ABG having a first articulated section, a second articulated section and a third articulated section, wherein the articulated sections are reinforced by a tape.
Figure 7:
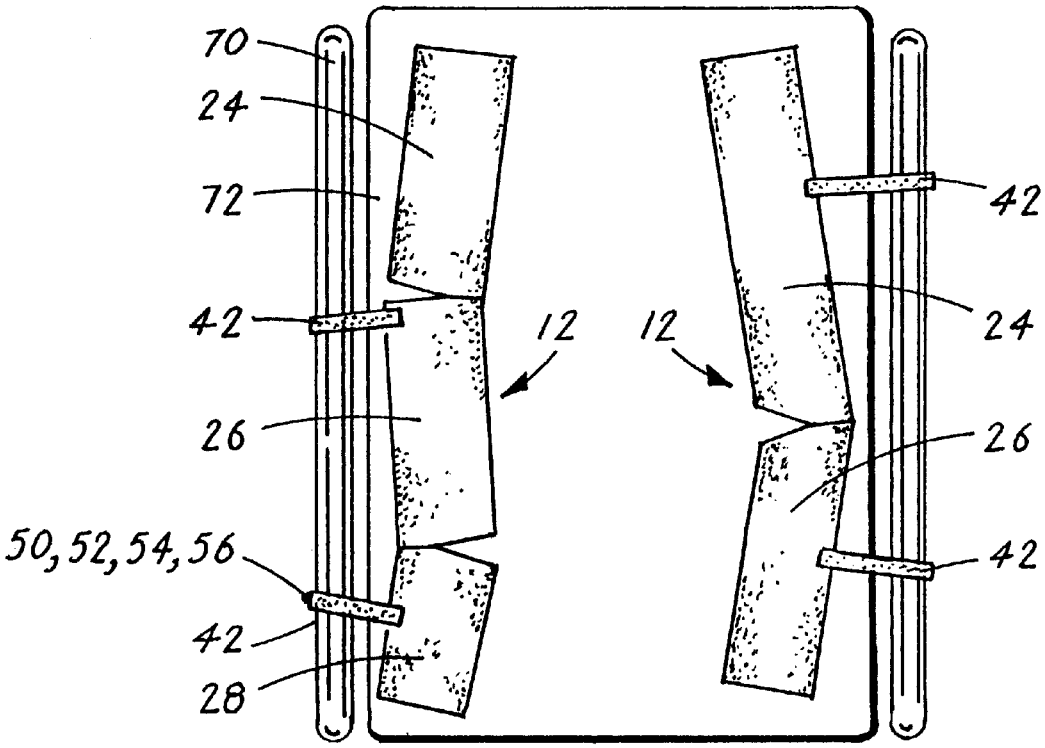
FIG. 7 is a top plan view of an ABG shown attached to the rail of a hospital bed. On the left side is shown an ABG having three articulated sections, and on the right side an ABG having two articulated sections.

The articulated sections function as the positioning means 20 to position the elongated, resilient section 12 to conform to the position of a body when the body is laying on a bed. The positioning means 20 can be comprised of the elongated resilient section 12 having at least one partial lateral cut 64, which divides the resilient section 12 into a first section 24 and a second section 26, as shown in FIGS. 1 and 4; or the elongated, resilient section 12 can have at least two partial lateral cuts 22, as shown in FIGS. 5 and 7, which divide the resilient section 12 into three articulated sections: a first section 24, a second section 26 and a third section 28. Note that in FIG. 5, the two partial lateral cuts 22 that divide the resilient section 12 into three articulated sections 24, 26, 28 are cut from opposite sides, which causes the first and third articulated sections 24, 28 to articulate in opposite directions as referenced from the second section 26. The articulated sections allow the ABG 10 to conform to the position of a patient and to the position of the articulations of the hospital bed 72.

The articulated sections are articulated by creating a partial lateral cut 22 into the section 12 as shown best in FIGS. 4 and 5. In order to maintain the structural integrity of the articulated sections, a strip of reinforcement adhesive tape 36 can be applied to the un-cut end of the sections, as also shown in FIGS. 4 and 5; or a piece of fabric 38 can be attached by an adhesive or by stitching, as also shown in FIG. 5.

The section/bed attachment means 40 is utilized to secure the elongated, resilient section 12 to the side rails 70 of a bed 72, as shown in FIGS. 6 and 7. One of the attachment means 40 can consist of a plurality of straps 42, each having a first end 44 that is attached to the section 12 by an attachment means 46, and a second end 48 that can be attached to a second strap by means of a looped tie 50, a pair of hook and loop fasteners 52, a complimentary pair of male and female detents 54, or a quick-release buckle 56. If a vertical support is not available, the attachment means 40 can consist of a combination hook and loop fastener 52 that is attached between the lower side of the section 12 and the bed 72, as also shown in FIG. 6.

Figure 8:
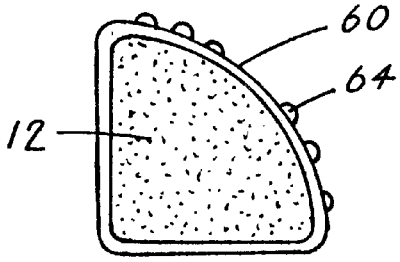
FIG. 8 is a front elevational and cross-sectional view of an ABG that is fully enclosed by a protective cover that may include a multiplicity of accupressure protrusions.
Figure 9:
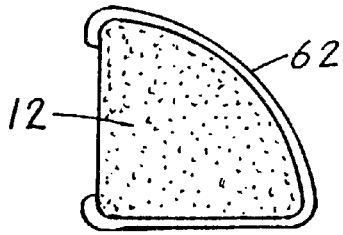
FIG. 9 is a front elevational and cross-sectional view of an ABG that is partially enclosed by a protective cover.

In order to protect the elongated resilient sections from body fluids or excessive wear, the section 12 is preferably treated with a liquid-repellant formulation 58, as shown in FIG. 1. Alternatively, or in combination with the formulation 58, a full cover 60, as shown in FIGS. 4 and 8, or a partial cover 62, as shown in FIG. 9, can be utilized. The full cover 60 is preferably attached by a zipper 64, and the partial cover 62 by an elastic band 66. In either configuration, the cover is preferably made of a washable flannel or cotton. However, the cover in some situations can be made of a light plastic.

Additionally, the cover 60 or 62 may include a multiplicity of protrusions 68, as also shown in FIG. 8, which aid in providing accupressure therapy.

While the invention has been described in complete detail and pictorially shown in the accompanying drawings it is not to be limited to such details, since many changes and modifications may be made to the invention without departing from the spirit and the scope thereof. Hence, it is described to cover any and all modifications and forms that may come within the language and scope of the appended claims.

What is claimed is:

1. An adjustable body guard adapted to be attached to a bed structure, said adjustable body guard comprising:

a) an elongated, resilient section having at least one partial lateral cut that divides said resilient section into a first articulated section and a second articulated section, b) means for positioning said adjustable body guard to conform to the position of a body lying on the bed and to the articulations of an adjustable bed, and c) means for attaching said adjustable body guard to the bed structure.

2. The adjustable body guard as specified in claim 1 wherein the bed structure is comprised of a side rail that is attached to a hospital bed.

3. The adjustable body guard as specified in claim 2 wherein said means for attaching said adjustable body guard to the side bed rail comprises a plurality of straps having a first end and a second end that are attached to said resilient section, wherein the two ends are wrapped around the side rails and secured thereto by a looped tie.

4. The adjustable body guard as specified in claim 3 wherein the two ends of said straps are secured by a complimentary pair of male and female detents.

5. The adjustable body guard as specified in claim 3 wherein the two ends of said strap are secured by a complimentary pair of hook and loop fasteners.

6. The adjustable body guard as specified in claim 1 wherein said resilient section has two partial lateral cuts, cut from opposite sides, that divide said resilient section into three articulated sections consisting of a first articulated section, a second articulated section and a third articulated section, wherein the first and third articulated sections articulate in opposite directions as referenced from the second section.

7. The adjustable body guard as specified in claim 6 wherein said resilient section is made from a polyurethane.

8. The adjustable body guard as specified in claim 7 wherein the polyurethane passes OGMR flammability regulations for the hospitality industry, which includes hospitals and hotels.

9. The adjustable body guard as specified in claim 6 wherein said resilient section has a quarter-circle cross-section having a curved surface that faces inward, a substantially flat lower surface, and a substantially flat outer surface.

10. The adjustable body guard as specified in claim 6 wherein said resilient section has a circular cross-section.

11. The adjustable body guard as specified in claim 6 wherein said resilient section has an elliptical cross-section.

12. The adjustable body guard as specified in claim 2 wherein said means for attaching said adjustable body guard to the side bed rail comprises a combination hook and loop fastener that is attached between said adjustable body guard and the side rails.

13. The adjustable body guard as specified in claim 6 wherein said means for positioning said adjustable body guard to conform to the shape of the body is provided by laterally positioning said articulated sections to conform to the position of a person lying on the bed.

14. The adjustable body guard as specified in claim 6 wherein said resilient section is treated with a liquid-repellant formulation.

15. The adjustable body guard as specified in claim 6 further comprising a full or partial fitted cover that is attached by an attachment means over said adjustable body guard.

16. An adjustable body guard adapted to be attached to a bed structure, said adjustable body guard comprising:

a) an elongated resilient section having at least one partial lateral cut that divides said resilient section into a first articulated section and a second articulated section, wherein to the uncut ends of the partial lateral cuts on the articulated section(s) is applied a strip of reinforcement material to maintain the structural integrity of the articulated section(s), b) means for positioning said adjustable body guard to conform to the position of a body lying on the bed and to the articulations of an adjustable bed, and c) means for attaching said adjustable body guard to the bed structure.

17. The adjustable body guard as specified in claim 16 wherein the reinforcement material is comprised of a reinforcement adhesive tape or a piece of stitched fabric.

18. An adjustable body guard adapted to be attached to a bed structure, said adjustable body guard comprising:

a) an elongated, resilient section having two partial lateral cuts, cut from opposite sides, that divide said resilient section into three articulated sections consisting of a first articulated section, a second articulated section and a third articulated section, wherein the first and third articulated sections articulate in opposite directions as referenced from the second section, b) means for positioning said adjustable body guard to conform to the position of a body lying on the bed and to the articulations of an adjustable bed, and c) means for attaching said adjustable body guard to the bed structure, and d) a full or partial fitted cover that is attached by a zipper or an elastic band over said adjustable body guard.

19. An adjustable body guard adapted to be attached to a side rail as found on a hospital bed, said adjustable body guard comprising:

a) an elongated resilient section that is treated with a liquid-repellant formulation and having a quarter-circle cross-section with a curved inner surface that faces a body lying on bed, a substantially flat lower surface and a substantially flat outer surface, with said resilient section having at least two partial lateral cuts that are cut from opposite sides to divide said resilient section into three articulated sections, consisting of a first section, wherein the first and third sections articulate in opposite directions as referenced from the second section, to allow said adjustable body guard to be positioned to conform to the position of a body lying on the bed, b) a full or fitted cover that is attached over the said elongated resilient section by means of a zipper or an elastic band, and c) means for attaching the covered said adjustable body guard to the side rails.

* * * * *